US006753475B2

(12) United States Patent
Takahashi et al.

(10) Patent No.: US 6,753,475 B2
(45) Date of Patent: Jun. 22, 2004

(54) SHIELDING TERMINAL FOR COAXIAL CABLE

(75) Inventors: Takakazu Takahashi, Haibara-gun (JP); Kimihiro Abe, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/286,828

(22) Filed: Nov. 4, 2002

(65) Prior Publication Data

US 2003/0089517 A1 May 15, 2003

(30) Foreign Application Priority Data

Nov. 9, 2001 (JP) ..... P2001-344858

(51) Int. Cl.[7] ..... H01R 9/05
(52) U.S. Cl. ..... 174/75 C; 174/84 C; 439/578
(58) Field of Search ..... 174/78, 75 C, 174/84 C, 94 R, 88 C; 439/578, 584, 585, 394, 866, 865, 867

(56) References Cited

U.S. PATENT DOCUMENTS 3,660,805 A * 5/1972 McDonough ..... 439/585
5,762,526 A * 6/1998 Kuramoto et al. ..... 439/877
5,772,454 A * 6/1998 Long, Jr. ..... 439/83
5,935,474 A * 8/1999 Grischenkov et al. ..... 219/549
6,375,521 B2 * 4/2002 Tachi et al. ..... 439/884
6,533,609 B2 * 3/2003 Koide ..... 439/578

* cited by examiner

*Primary Examiner*—Chau N. Nguyen
(74) *Attorney, Agent, or Firm*—Sughrue Mion, PLLC

(57) ABSTRACT

A shielding terminal for a coaxial cable includes a first clamping portion, a second clamping portion and a junction portion. The first clamping portion clamps an insulative sheath of the coaxial cable. The second clamping portion clamps a exposed conductive braid portion of the coaxial cable. The junction portion is formed integrally between the first clamping portion and the second clamping portion. The junction portion extends around an outer periphery of the coaxial cable in which a winding angle of the junction portion with respect to the coaxial cable is not less than 180 degrees, and in which the winding angle of the junction portion is smaller than winding angles of the first clamping portion and the second clamping portion with respect to the coaxial cable respectively.

7 Claims, 6 Drawing Sheets

SHIELDING TERMINAL FOR COAXIAL CABLE

BACKGROUND OF THE INVENTION

This invention relates to a shielding terminal for a coaxial cable, and more particularly to a shielding terminal for a coaxial cable which has a press-clamping portion for being press-fastened to an end portion of the coaxial cable, and is electrically connected to a braid of the coaxial cable exposed at the end portion thereof.

Generally, in order to block electrical noises such as electromagnetic waves and static electricity, a coaxial cable, used as an antenna wire or the like, is constructed that a conductor is covered with an inner insulative covering, the inner insulative covering is covered with a braid, and this braid is covered with an insulative sheath.

There have been proposed various coaxial connectors for connecting such a coaxial cable to a mating equipment or a mating connector.

In such a coaxial connector, there is used a shielding terminal for a coaxial cable which connects the braid of the coaxial cable to the mating connector for grounding purposes. One example of such terminals is shown in FIGS. 4 and 5.

The shielding terminal 1 for the coaxial cable is formed by bending a conductive metal plate as shown in FIGS. 4 and 5, and this terminal includes a terminal body 4 of a rectangular tubular cross-section, formed by a pair of half-split box portions 3, extending upwardly respectively from opposite side edges of a front end portion (left end portion in the drawings) of a terminal bottom plate portion 2, and a press-clamping portion 7 which includes a pair of braid-clamping piece portions 5, extending upwardly respectively from opposite side edges of a rear-side portion (right-side portion in the drawings) of the terminal bottom plate portion 2 so as to be fastened and connected by pressing to a braid 12 of the coaxial cable 10, and a pair of sheath-clamping piece portions 6 (see FIG. 6A) extending upwardly respectively from opposite side edges of a rear end portion (right end portion in the drawings) of the terminal bottom plate portion 2 so as to be fastened and connected by pressing to an insulative sheath 13 of the coaxial cable 10.

An inner terminal (not shown) of a cylindrical shape is press-fastened and connected to that portion of a conductor 14 exposed at an end portion of the coaxial cable 10 by removing part of an inner insulative covering 11, and thereafter the shielding terminal 1 is press-fastened and connected to the end portion of the coaxial cable. Then, the inner terminal, inserted in the terminal body 4 of the shielding terminal 1, is held in an insulative inner housing (not shown), and thereafter the shielding terminal 1 is received and held in a terminal receiving portion of an insulative outer housing (not shown), thus assembling a coaxial connector.

Therefore, when the coaxial connector is fitted into a mating equipment or the like (not shown), the braid 12 is connected to the equipment for grounding purposes via the shielding terminal 1, so that the coaxial cable 10 is electromagnetic shielded.

In the above shielding terminal 1, the press-clamping portion to be press-fastened and connected to the end portion of the coaxial cable 10 includes the braid-clamping piece portions 5 and the sheath-clamping piece portions 6 which are arranged serially at the opposite side edges of the rear end portion of the terminal bottom plate portion 2.

Therefore, when the coaxial cable 10, press-fastened and connected to the shielding terminal 1, is pulled upwardly as indicated in imaginary lines (two doted lines) in FIG. 5, with the coaxial connector fitted in the mating equipment or the like, an external force acts on the sheath-clamping piece portions 6 in a diameter-increasing direction, which leads to a possibility that the pair of press-fastened sheath-clamping piece portions 6 are opened as shown in FIG. 6B.

If the pair of sheath-clamping piece portions 6 are excessively press-fastened in order to secure the clamping force of these sheath-clamping piece portions 6, that portion of the coaxial cable 10, held by the press-clamping portion, is crushed radially, so that the roundness of the braid 12 can not be maintained, and this invites a problem that the characteristic impedance of the coaxial cable would be adversely affected. Therefore, usually, the braid-clamping piece portions 5, as well as the sheath-clamping piece portions 6, are press-fastened, with their distal ends abutted against each other.

If the pair of sheath-clamping piece portions 6 are excessively increased in width in order to secure the clamping force of these sheath-clamping piece portions 6, the overall length of the clamping portion becomes too large, which invites a problem that it is difficult to achieve a compact design of the shielding terminal 1 and a compact design of the outer housing.

SUMMARY OF THE INVENTION

It is therefore an object of the present invention to provide a shielding terminal for a coaxial cable which can secure a necessary force of fixing of the terminal to an end portion of the coaxial cable without increasing the size of the terminal.

In order to achieve the above object, according to the present invention, there is provided a shielding terminal for a coaxial cable comprising:

- a first clamping portion, which clamps an insulative sheath of the coaxial cable;
- a second clamping portion, which clamps a exposed conductive braid portion of the coaxial cable; and
- a junction portion, formed integrally between the first clamping portion and the second clamping portion;
- wherein the junction portion, extends around an outer periphery of the coaxial cable in which a winding angle of the junction portion with respect to the coaxial cable is not less than 180 degrees, and in which the winding angle of the junction portion is smaller than winding angles of the first clamping portion and the second clamping portion with respect to the coaxial cable respectively.

In the above construction, the first clamping portion to be press-fastened to the sheath of the coaxial cable is formed integrally with the second clamping portion through the junction portion.

Therefore, when an external force acts on the first clamping portion in a diameter-increasing direction, the second clamping portion also resists this external force, acting in the diameter-increasing direction, through the junction portion, and therefore the force of fixing of the terminal with respect to the coaxial cable can be increased.

Preferably, the shielding terminal for a coaxial cable, wherein the winding angles of the first clamping portion and the second clamping portion are substantially 360 degrees respectively. With this construction, the shielding terminal can be more positively fixed to the coaxial cable, and besides the shielding performance is enhanced.

DETAILED DESCRIPTION OF THE PREFERRED EMBODIMENTS

One preferred embodiment of a shielding terminal of the present invention will now be described in detail with reference to the accompanying drawings.

Figure 1:
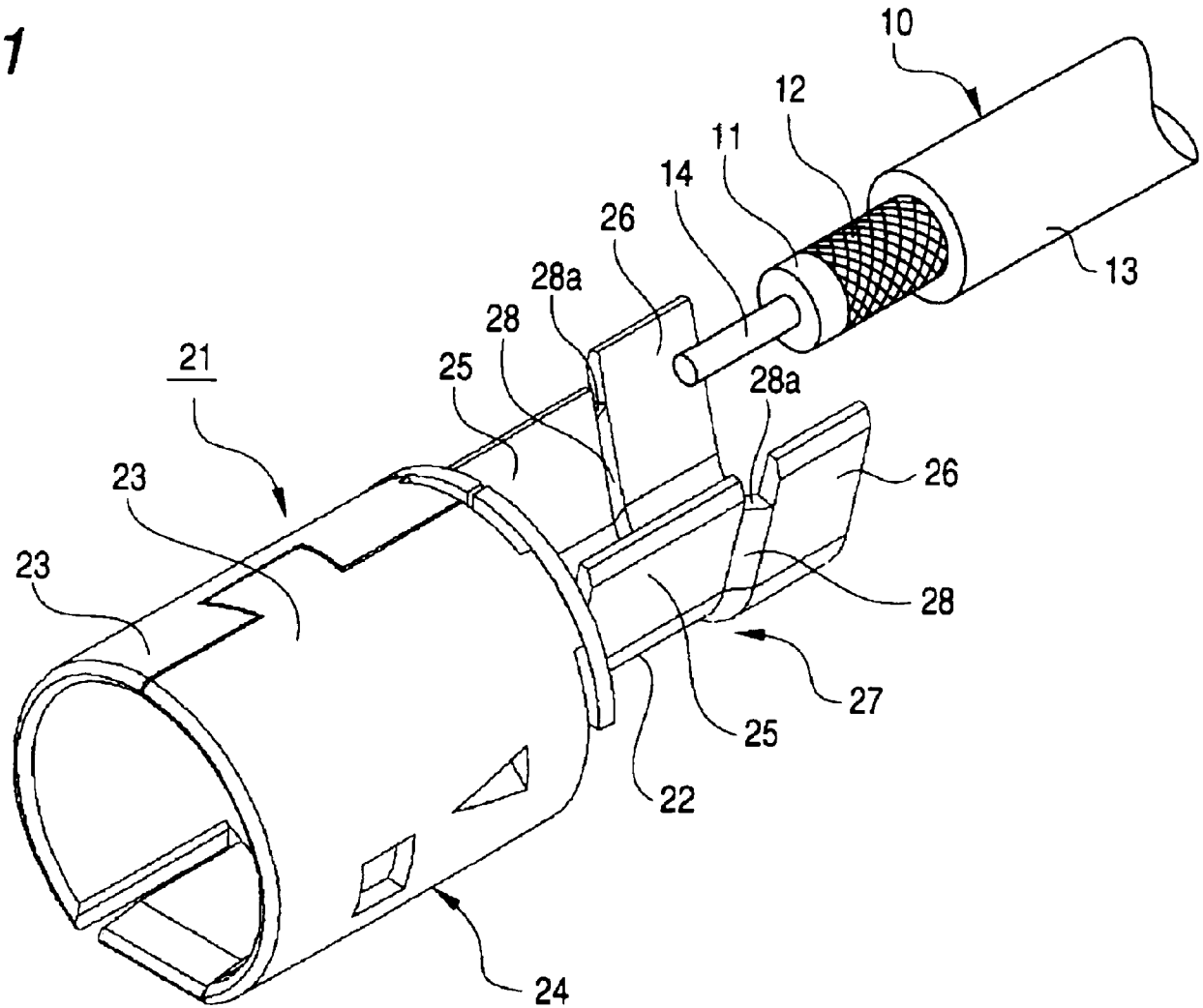
FIG. 1 is a perspective view showing the whole of one preferred embodiment of a coaxial cable-shielding terminal of the present invention.

As shown in FIG. 1, the shielding terminal 21 of this embodiment is formed by bending a conductive metal plate, and this terminal includes a terminal body 24 of a cylindrical tubular cross-section, formed at a front end portion (left end portion in the drawings) of a terminal bottom plate portion 22, and a press-clamping portion 27 formed at a rear end portion (right end portion) of the terminal bottom plate portion 22.

Figure 4:
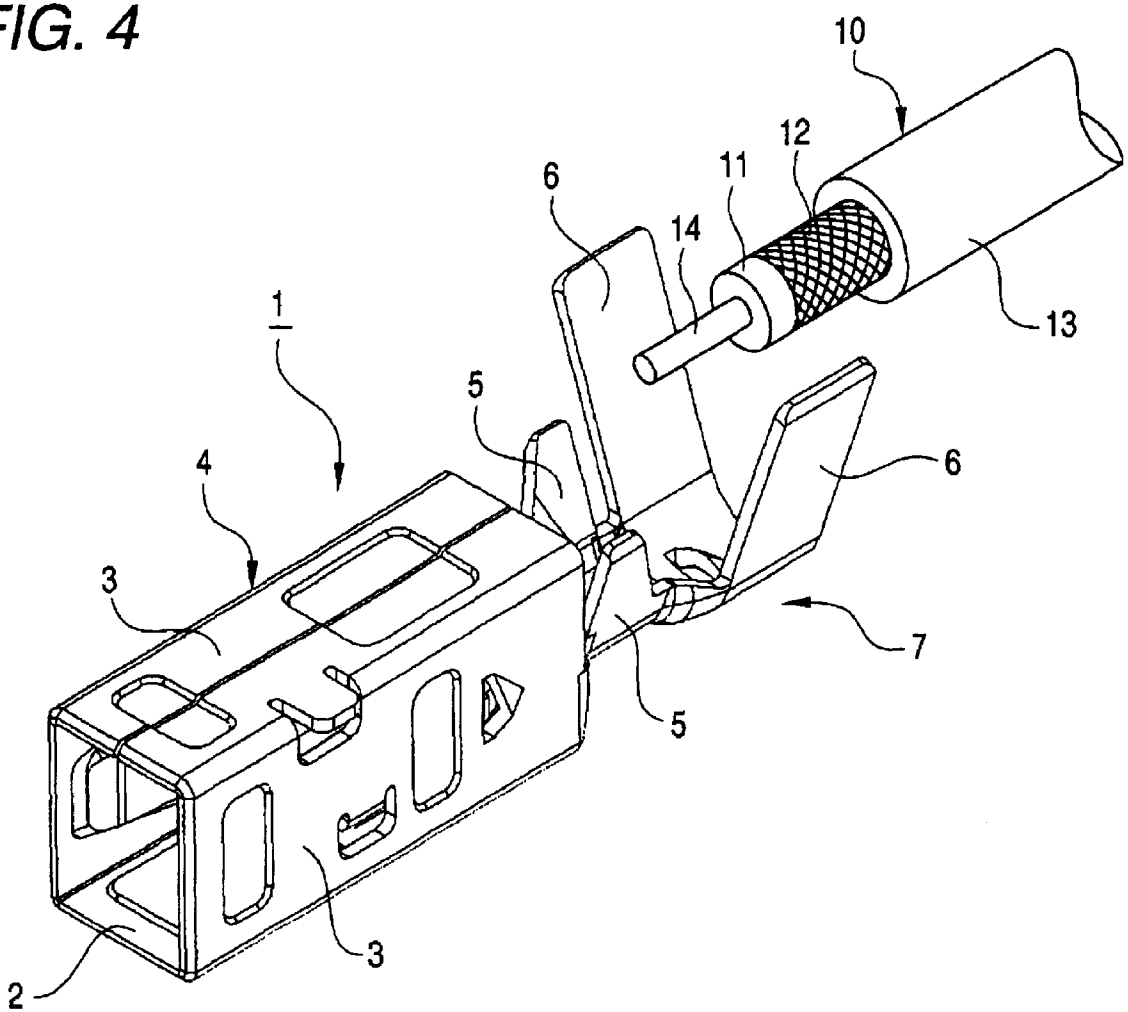
FIG. 4 PRIOR ART
FIG. 4 is a perspective view showing the whole of a related coaxial cable-shielding terminal.

The terminal body 24 is formed into the cylindrical tubular cross-section by a pair of half-split box portions 23 extending upwardly respectively from opposite side edges of the front end portion of the terminal bottom plate portion 22. However, the terminal body of the present invention is not limited to this shape, but can have any other suitable shape such as a rectangular tubular cross-sectional shape as shown in FIG. 4 and a triangular tubular cross-sectional shape.

The press-clamping portion 27 includes a pair of braid-clamping portions 25, extending upwardly respectively from the opposite side edges of the terminal bottom plate portion 22 so as to be fastened and connected by pressing to a braid 12 of the coaxial cable 10, and a pair of sheath-clamping portions 26 extending upwardly respectively from the opposite side edges of that portion of the terminal bottom plate portion 22, disposed adjacent to the braid-clamping portions 25, so as to be fastened and connected by pressing to an insulative sheath 13 of the coaxial cable 10.

Figure 3:
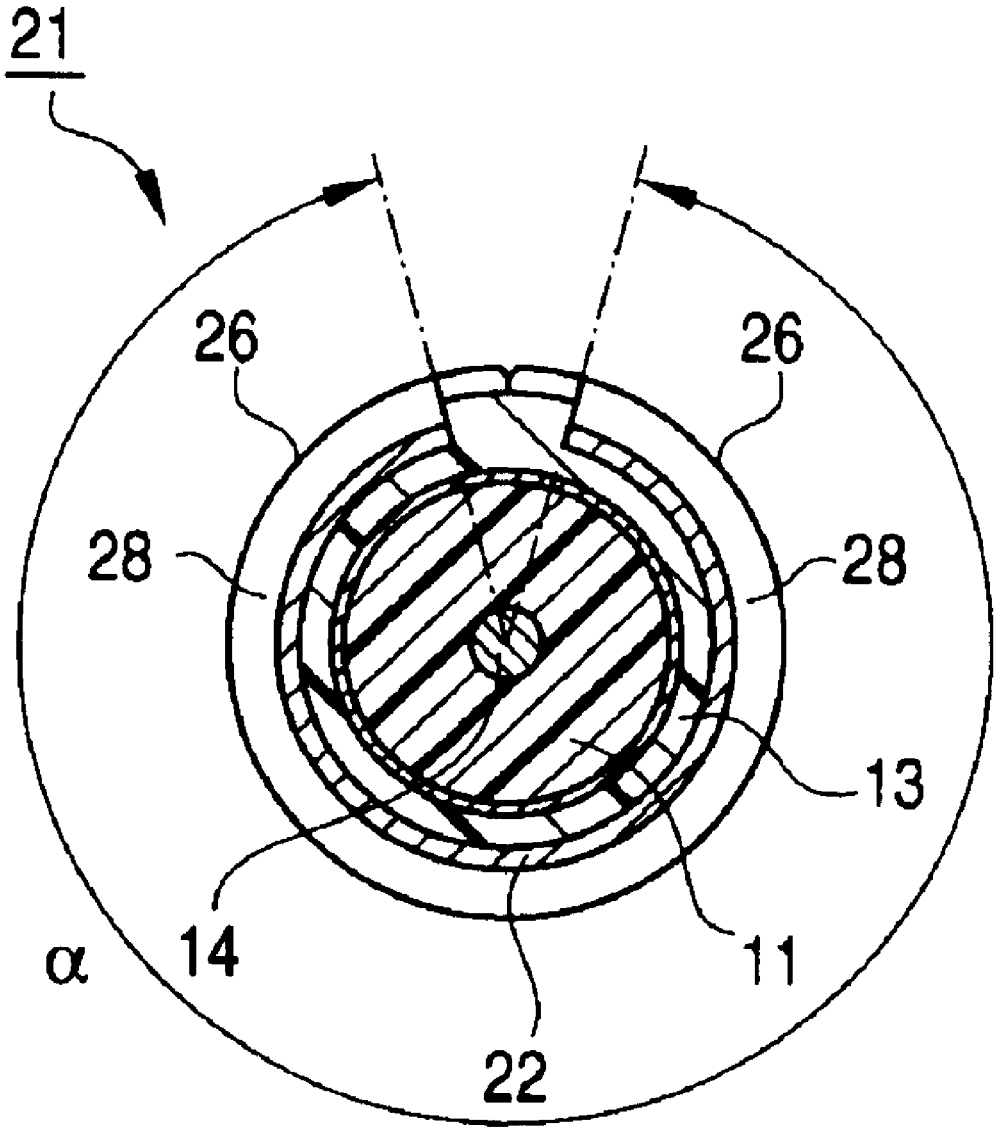
FIG. 3 is a cross-sectional view taken along the line III—III of FIG. 2.

Reinforcing junction portions 28 are formed integrally between the braid-clamping portions 25 and the sheath-clamping portions 26, and extend respectively from the opposite side edges of the terminal bottom plate portion 22 so as to extend around the outer periphery of the coaxial cable 10 over a winding angle $\alpha$ at least not smaller than a half of the circumference of the coaxial cable (see FIG. 3).

The braid-clamping portions 25 and the sheath-clamping portions 26, forming the press-clamping portion 27, and the reinforcing junction portions 28 are jointly formed into an integral configuration.

Figure 2:
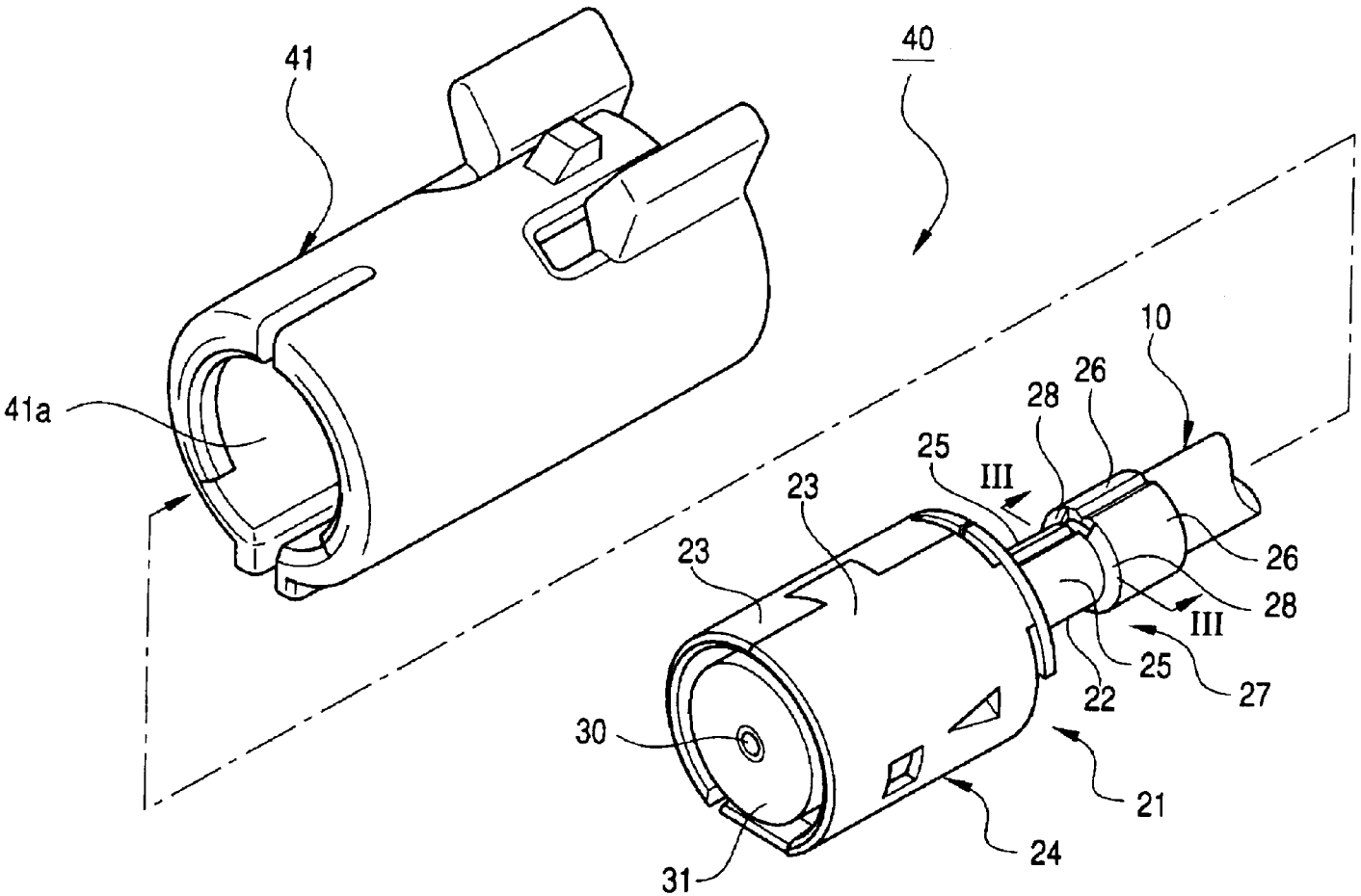
FIG. 2 is an exploded, perspective view showing a coaxial connector employing the coaxial cable-shielding terminal of FIG. 1.

The reinforcing junction portions 28 interconnect the braid-clamping portions 25 and the sheath-clamping portions 26 which are different in inner diameter after these clamping portions are press-fastened, and therefore the reinforcing junction portions 28 must be formed into a generally conical, tapering shape as shown in FIG. 2. Therefore, relief recesses 28*a* for relieving internal strains, developing upon press-fastening, are formed respectively at ends of the reinforcing junction portions 28 to be opposed to each other when they are press-fastened in a generally butted manner. However, if such internal strains, developing upon press-fastening, can be suppressed by factors such as a material and a plate thickness, then the formation of the relief recesses 28*a* is not always necessary, and the present invention is not limited to such a construction.

An inner terminal 30 of a cylindrical shape is press-fastened and connected to that portion of a conductor 14 exposed at the end portion of the coaxial cable 10 by removing part of an inner insulative covering 11, and thereafter the press-clamping portion 27 of the shielding terminal 21 is press-fastened and connected to the end portion of the coaxial cable.

Namely, the press-clamping portion 27, in which the pair of braid-clamping portions 25 and the pair of sheath-clamping portions 26 are formed into the integral configuration through the reinforcing junction portions 28, is press-fastened and connected to the end portion of the coaxial cable 10.

Then, the inner terminal 30, inserted in the terminal body 24 of the shielding terminal 21, is held in an insulative inner housing 31, and thereafter the shielding terminal 21 is received and held in a terminal receiving portion 41*a* of an insulative outer housing 41, thus assembling the coaxial connector 40.

Therefore, when the coaxial connector 40 is fitted into a mating equipment or the like (not shown), the braid 12 is connected to the equipment for grounding purposes via the shielding terminal 21, so that the coaxial cable 10 is electromagnetically shielded.

Thus, in construction of the shielding terminal 21 of this embodiment, the sheath-clamping portions 26 of the press-clamping portion 27 to be press-fastened and connected to the end portion of the coaxial cable 10 are formed integrally with the braid-clamping portions 25 through the reinforcing junction portions 28.

Therefore, when the coaxial cable 10, press-fastened and connected to the shielding terminal 21, is pulled upwardly, with the coaxial connector 40 fitted in the mating equipment or the like, so that an external force acts on the sheath-clamping portions 26 in a diameter-increasing direction, the braid-clamping portions 25 also can resist this external force, acting in the diameter-increasing direction, through the reinforcing junction portions 28.

Figure 5:
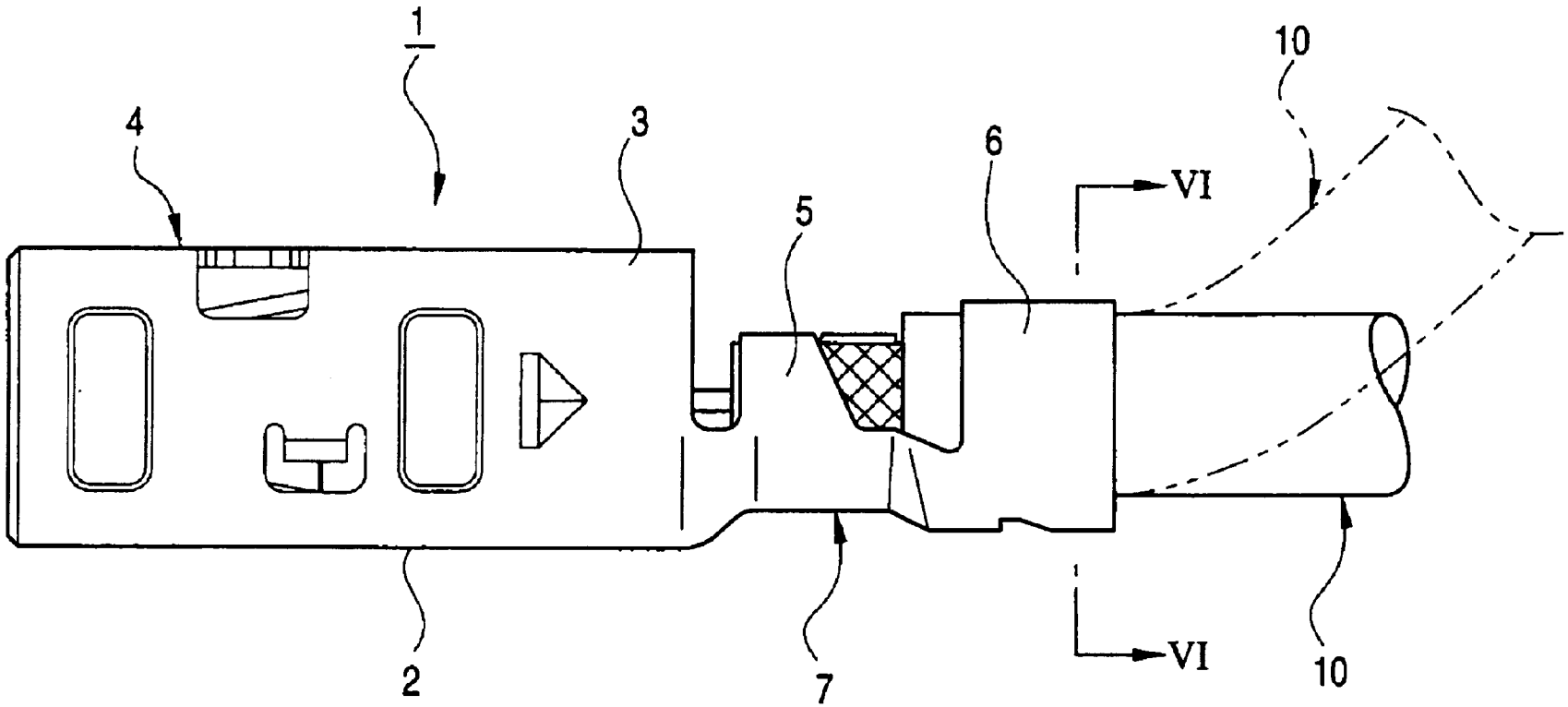
PRIOR ART FIG. 5
FIG. 5 is a front-elevational view showing a condition in which the coaxial cable-shielding terminal of FIG. 4 is press-fastened and connected to an end portion of a coaxial cable.
Figure 6A:
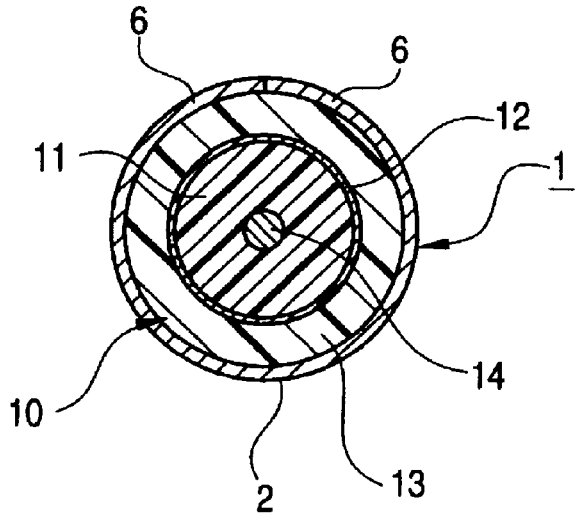
PRIOR ART FIG. 6A
FIG. 6A is a cross-sectional view taken along the line VI—VI of FIG. 5, showing sheath-clamping piece portions in a proper condition.
Figure 6B:
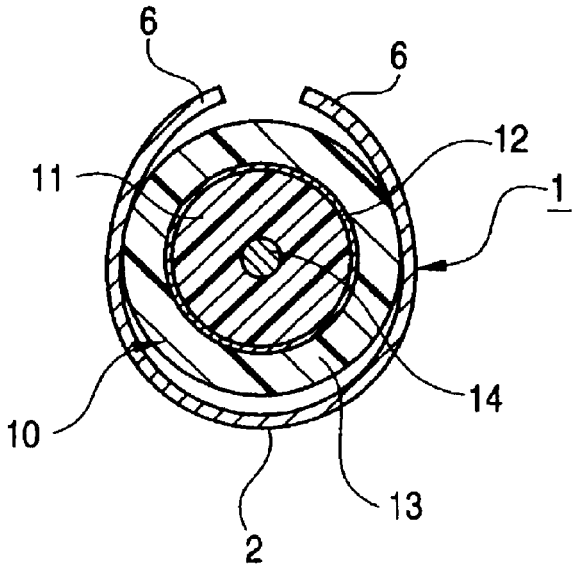
PRIOR ART FIG. 6B
FIG. 6B is a cross-sectional view taken along the line VI—VI of FIG. 5, showing the sheath-clamping piece portions in an open condition.

Namely, in the shielding terminal 21 of this embodiment, the force of fixing of the terminal to the end portion of the coaxial cable 10 is larger than in the related shielding terminal 1 of FIG. 5, and therefore it is not necessary to excessively press-fasten the press-clamping portion 27 in order to secure the clamping force of the pair of sheath-clamping portions 26. Therefore, the press-fastened portion of the coaxial cable 10 will not be crushed radially, and there will not be encountered a situation in which the roundness of the braid 12 is not maintained, and therefore the characteristic impedance of the coaxial cable will not be adversely affected.

And besides, it is not necessary to increase the length of the pair of sheath-clamping portions 26 in the axial direction of the terminal in order to secure the clamping force, and the overall length of the press-clamping portion 27 can be made smaller than that of the press-clamping portion 7 of the related shielding terminal 1 of FIG. 5, and therefore the small-size design of the shielding terminal 21, as well as the small-size design of the outer housing 41, can be easily achieved.

In the above embodiment, the braid-clamping portions 25 substantially completely cover the outer peripheral face of that portion of the braid 21, exposed at the end portion of the coaxial cable 10, and also the sheath-clamping portions 26 substantially completely cover the outer peripheral face of the insulative sheath 13 at the end portion of the coaxial cable 10. Therefore, the shielding terminal 21 of this embodiment can be more positively fixed to the end portion of the coaxial cable 10, and besides the shielding performance is enhanced.

The shielding terminal 21 of the present invention is not limited to the construction of the above embodiment, but the shielding terminal can take any other suitable form on the basis of the subject matter of the present invention.

For example, the reinforcing junction portions 28 of the coaxial cable-shielding terminal of the invention need only to extend respectively from the opposite side edges of the terminal bottom plate portion 22 so as to extend around the outer periphery of the coaxial cable 10 over the winding angle $\alpha$ at least not smaller than a half of the circumference, and thus those portions, which extend around the outer periphery of the coaxial cable 10 over the winding angle $\alpha$ at least not smaller than a half of the circumference, serve as the reinforcing interconnecting portions 28. In this construction, the braid-clamping portions 25 can resist the external force, acting on the sheath-clamping portions 26 in the diameter-increasing direction, through the reinforcing junction portions 28. Incidentally, the fixing force of the sheath-clamping portions 26 is larger as the winding angle $\alpha$ is larger.

What is claimed is:

1. A shielding terminal for a coaxial cable, comprising:

a first clamping portion, which clamps an insulative sheath of the coaxial cable;

a second clamping portion, which clamps a exposed conductive braid portion of the coaxial cable; and a junction portion, formed integrally between the first clamping portion and the second clamping portion;

wherein the junction portion, extends around an outer periphery of the coaxial cable in which a winding angle of the junction portion with respect to the coaxial cable is not less than 180 degrees, and in which the winding angle of the junction portion is smaller than winding angles of the first clamping portion and the second clamping portion with respect to the coaxial cable respectively.

2. The shielding terminal for a coaxial cable according to claim 1, wherein the winding angles of the first clamping portion and the second clamping portion are substantially 360 degrees respectively.

3. The shielding terminal for a coaxial cable according to claim 1, wherein the first clamping portion and the second clamping portion have different inner diameters.

4. The shielding terminal for a coaxial cable according to claim 3, wherein the junction portion has a substantially conical shape.

5. The shielding terminal for a coaxial cable according to claim 3, wherein the junction portion is tapered.

6. The shielding terminal for a coaxial cable according to claim 1, wherein the junction portion has relief recesses formed respectively at each end of the junction portion.

7. The shielding terminal for a coaxial cable according to claim 1, wherein the junction portion has a pair of side portions extending in a winding direction thereof; and wherein the side portions are respectively connected to the first clamping portion and the second clamping portion.

* * * * *